United States Patent [19]

McKee

[11] 4,167,863

[45] Sep. 18, 1979

[54] FINGER LOOP KEY TAG

[76] Inventor: Raymond J. McKee, Box 246, Wayne, N.J. 07470

[21] Appl. No.: 890,818

[22] Filed: Mar. 24, 1978

[51] Int. Cl.[2] ..... A47G 29/10

[52] U.S. Cl. ..... 70/457

[58] Field of Search ..... 70/456 R, 457, 458; 150/40; 24/3 K

[56] References Cited

U.S. PATENT DOCUMENTS 3,828,595 8/1974 Williams ..... 70/457

*Primary Examiner*—Robert L. Wolfe

*Attorney, Agent, or Firm*—Clarence A. O'Brien; Harvey B. Jacobson

[57] ABSTRACT

A key ring assembly comprised of a flexible finger loop member carried on a key ring. The finger loop member is formed from a flat elongated sheet of a suitably flexible material and has an aperture formed in each end thereof through which the key ring is received, the flat elongated sheet comprising the finger loop member being formed into a loop when assembled onto the key ring. The material from which the finger loop member is formed preferably comprises a 3:1 mixture of high density to low density polyethylene, the thickness of the flat elongated sheet comprising the finger loop member preferably being between 0.035 and 0.040 inch in order to provide the desired flexibility and conformational integrity.

9 Claims, 9 Drawing Figures

FINGER LOOP KEY TAG

BACKGROUND OF THE INVENTION

1. Field of the Invention

The invention relates generally to tag structures, particularly tag structures which can be carried on a key ring to provide a finger loop having a desired degree of flexibility, strength, and resistance to crease and deformation. The invention further relates to tag-like articles of manufacture preferably formed of suitably flexible thermoplastic materials.

2. Description of the Prior Art

Key ring structures have long been known in the art, such structures taking a variety of forms and often bearing articles thereon for identification or for other purposes. As examples, Kalkbrenner and Milleson respectively disclose in U.S. Pat. Nos. 1,338,181 and 930,776 ring structures adapted to carry a plurality of keys and further having identification tags carried by the same ring which carries the keys. In particular, these prior devices include identification tags which are substantially planar in conformation and have a single aperture disposed in the tag structure, the aperture receiving the key ring therethrough. Imhoff, in U.S. Pat. No. 2,292,563, discloses a finger ring having a hook-like key receiving extension formed thereon. In U.S. Pat. No. 2,985,006, Du Bois discloses a key ring having a loop formed thereon which is adapted to receive the finger of a user. These prior structures do not provide an inexpensive finger loop member which can be carried on a key ring and which, due to the structural conformation and flexibility thereof, is conveniently disposed for receiving the finger of a user therethrough in virtually any orientation of the total structure. The present invention provides an inexpensive key ring and finger loop assembly wherein both ends of a plastic loop member are fitted onto the key ring, the assembled structure therefor having two loops one of which is adapted to hold a plurality of keys and the other of which is adapted to receive the finger of a user.

SUMMARY OF THE INVENTION

The present invention provides a key ring and finger loop assembly comprised of a conventional key ring which is adapted to receive and retain a plurality of keys or similar articles thereon, a finger loop member being thereby formed according to the present invention from a flat elongated sheet of a suitably flexible material. The flat elongated sheet of the invention has an aperture formed in each end thereof through which the key ring is received. The flat elongated sheet is thereby formed into a loop-like conformation, the flexibility of the material from which the sheet is formed providing a resiliency to the finger loop member which causes the loop member to be carried on the key ring under a tension which tends to restore the substantially planar elongated conformation of said sheet which existed prior to disposition of the sheet onto the key ring. In effect, the present structure comprises a conventional key ring having a plastic loop carried thereon, both ends of the plastic loop being fitted onto the key ring through an aperture formed in each of spaced ends of the loop. The key ring portion of the structure is adapted to carry a plurality of keys, the plastic loop acting to extend from the key ring and to maintain a loop-like conformation such that a user can insert a finger into the finger loop to facilitate grasping and carrying of the structure.

Since the finger loop member when mounted on the key ring is under tension due to the inherent resiliency of the material from which said loop member is formed, the finger loop member usually will extend outwardly of the remaining articles carried on the key ring when the assembly is casually dropped onto a surface such as a tabletop or the like. Therefore, the finger loop member is usually disposed in a position which enables convenient and ready insertion of a finger of a user into the finger loop member for grasping and carrying thereof. This ability of the finger loop member to extend outwardly or "standup" is caused in part by the weight of the member. However, this capability is primarily a result of the formation of the finger loop member from an initially flat elongated sheet of a suitably flexible material, the material preferably comprising a 3:1 mixture of high density to low density polyethylene. Further, the polyethylene sheet material from which the finger loop member is formed is preferably formed into a thickness between 0.035 and 0.040 inch in order to provide a desired degree of flexibility and resistance to creasing and deformation. The preferred material from which the present finger loop member is formed comprises linear polyethylene which has long been known to exist in both high density and low density forms, these forms having previously been extruded in sheet form for varying purposes. In particular, sheets of high density polyethylene have a relatively high tensile strength but a relatively low impact strength. In effect, high density polyethylene forms a stiff sheet-like article, such an article tending to crack and retain a crease when folded or bent in normal use. Use of high density polyethylene to form the present finger loop member is further undesirable due to the fact that the higher stiffness of the high density polyethylene material resists compression of the spaced ends of the finger loop member together, which compression is desirable when the finger loop member is to be compressed out of the way of the keys carried on the key ring, such as when a key is being inserted into a lock.

Sheet material formed of low density polyethylene has a low tensile strength and is too flexible for the heavy use encountered by the present structure. By forming the sheet material from which the present finger loop member is made from a mixture of high density and low density polyethylene, preferably a 3:1 mixture, a finger loop member is provided which has the desired degree of flexibility and tear strength and which can also be printed or written upon without the difficulty encountered with prior art polyethylene sheet material.

It is therefore an object of the present invention to provide a combined key ring and finger loop structure wherein the finger loop has spaced ends thereof mounted on the key ring to form a loop-like element on said key ring into which the finger of a user can be inserted for ready grasping and portability of the structure.

It is another object of the invention to provide a finger loop member adapted to be mounted on a key ring, the finger loop member being of a weight and flexibility to cause said finger loop member to normally extend upwardly from the key ring or to remain open regardless of the disposition of said loop member relative to the key ring, thereby to facilitate grasping and use of the structure.

It is a further object of the invention to provide a finger loop member adapted to be mounted on a key ring, the finger loop member being preferably formed of a flexible, inherently resilient material such as a mixture of high density and low density polyethylene formed into a sheet material having a preferred thickness of between 0.035 and 0.040 inch.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
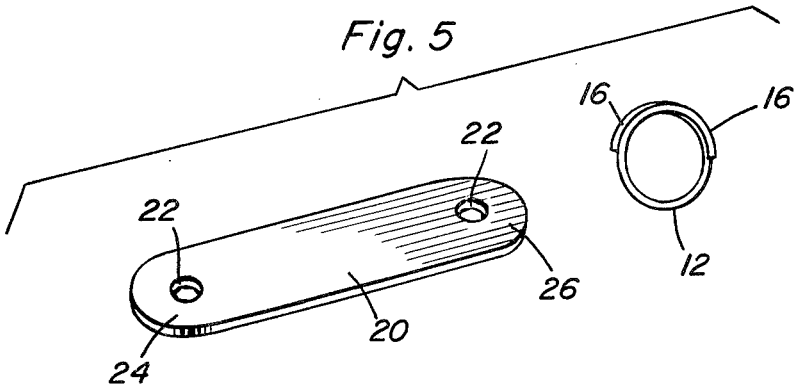
FIG. 5 is an assembly view of the key ring and the sheet-like article from which the finger loop member of the invention is formed.

Referring now to the drawings and particularly to FIGS. 1 through 7, a key ring and finger loop assembly according to the invention is shown generally at 10 to comprise a key ring 12 and a finger loop member 18, the key ring 12 being of conventional structure and being adapted to receive and hold keys 14 thereon in a known manner. The key ring 12 is provided with overlapping portions 16 which are separable and resiliently deformable in a known manner to facilitate mounting and retention of the keys 14 on the ring 12. The finger loop member 18, as particularly seen in FIG. 5, is formed of an elongated body 20 which is preferably stamped or otherwise formed from sheet stock comprised of a material having inherent flexible resiliency, such material comprising sheet metals, composite materials, or plastic materials having suitable characteristics. However, it is preferred to utilize the suitably flexible material disclosed by McKee in U.S. patent application Ser. No. 849,661, filed Nov. 3, 1977, the disclosure of which application is incorporated hereinto by reference. This material comprises a mixture of high density and low density polyethylene, the ratio of high density to low density polyethylene being 3:1. The polyethylene material from which the body 20 is thus formed is preferably caused to have a thickness of between 0.035 and 0.040 inch, thereby to yield a preferred degree of flexibility and conformational integrity to the finger loop member 18.

The body 20 is further seen to have an aperture 22 formed in each of ends 24 and 26 of the body 20. The key ring 12 is received within each of the apertures 22 to provide the structure particularly seen in FIG. 1, the body 20 taking the form of a loop wherein the ends 24 and 26 are spaced apart. Due to the inherent resiliency of the material from which the body 20 is formed, the finger loop member 18 continuously exerts a restoring force which tends to hold the finger loop member 18 under tension on the key ring 12. This restoring force acts to displace the ends 24 and 26 of the body 20 away from each other, thereby providing advantages to the assembly 10 not previously available in the art.

Figure 1:
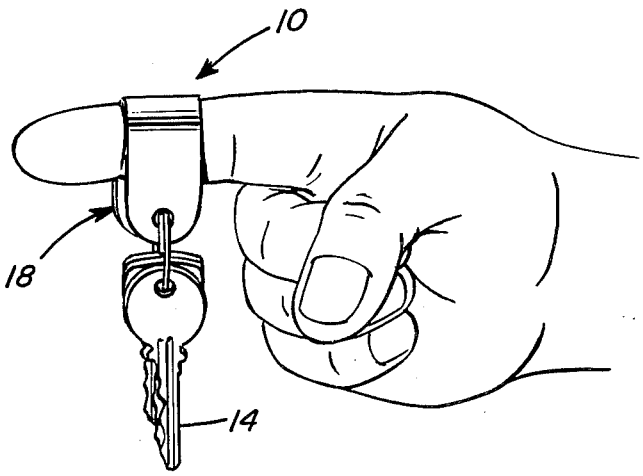
FIG. 1 is a perspective view illustrating the present key ring and finger loop assembly, the finger loop member of the assembly being shown as receiving a finger of a user therethrough.
Figure 2:
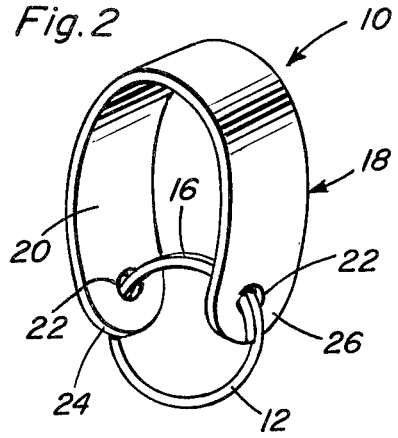
FIG. 2 is a perspective view of the key ring and finger loop assembly of the invention.
Figure 3:
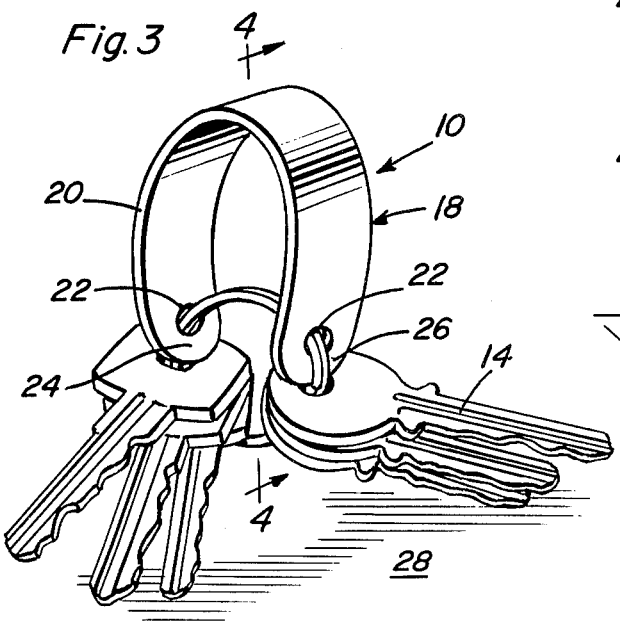
FIG. 3 is a perspective view of the present invention in an operational situation, the key ring of the invention having a plurality of keys mounted thereon, the assembly being disposed on a planar surface.
Figure 4:
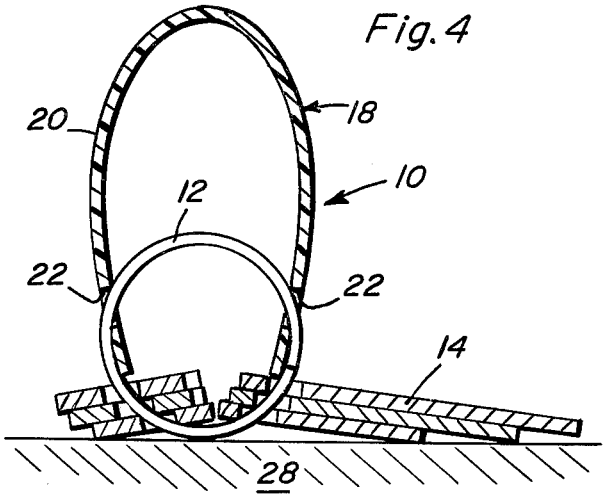
FIG. 4 is a sectional view taken generally along lines 4—4 of FIG. 3.
Figure 6:
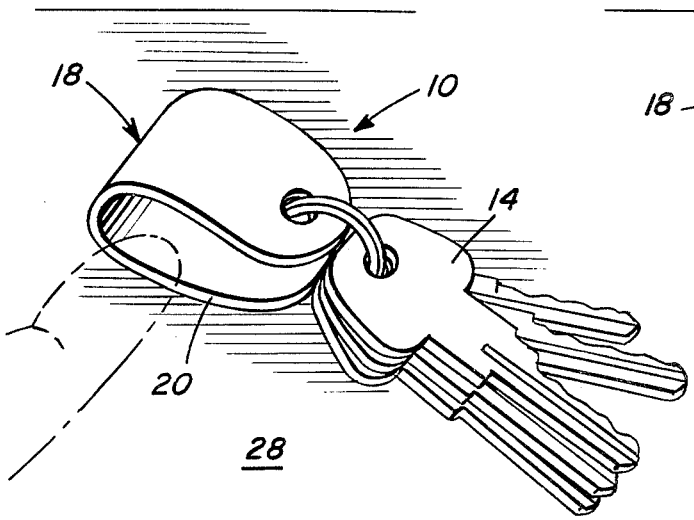
FIG. 6 is a perspective view of the present key ring and finger loop assembly shown in one possible disposition thereof on a planar surface.
Figure 7:
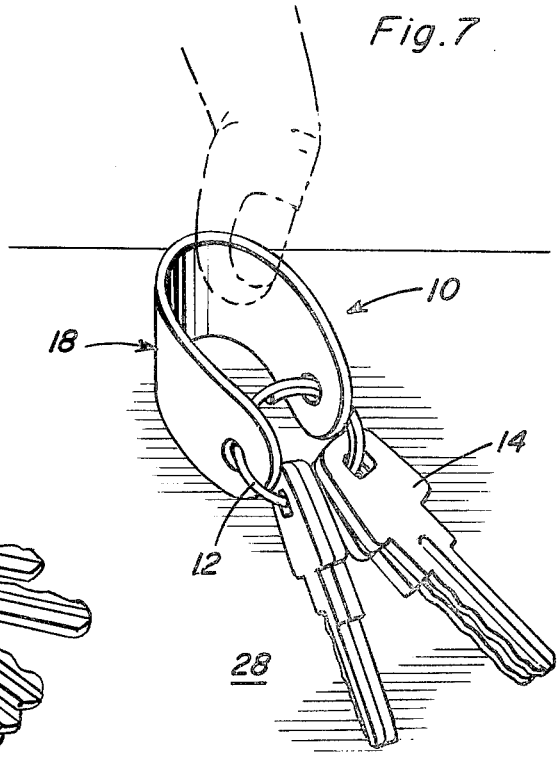
FIG. 7 is a perspective view of the present key ring and finger loop assembly shown in a further possible disposition on a planar surface.

As seen particularly in FIG. 1, the finger loop member 18 naturally assumes a loop-like conformation, thereby enabling the finger of a user of the assembly 10 to be inserted through the finger loop member 18 to facilitate use of the assembly 10. As further seen in FIGS. 3 and 4, the weight and inherent flexible resiliency of the finger loop member 18 acts to cause the finger loop member 18 to "standup" or extend from the key ring 12 when the key-bearing assembly 10 is caused to be disposed on a planar surface 28. Therefore, the finger loop member 18 positions itself such that a user of the assembly 10 can insert a finger through said finger loop member 18 for ready pick-up of the assembly 10. As can be seen in FIGS. 6 and 7, the loop portion of the finger loop member 18 is readily accessible to the finger of a user even when either of the arcuate side portions of the finger loop member 18 are disposed against the planar surface, as seen in FIG. 6, or when either lateral edge of the finger loop member 18 is disposed against the planar surface 28, as seen in FIG. 7. In essentially any disposition of the key ring and finger loop assembly 10, the finger loop member 18 is conveniently positioned such that a user can readily grasp the assembly 10 by inserting a finger through the finger loop member 18.

The finger loop member 18 is capable of providing the advantages indicated to differing degrees depending upon the choice of material from which said member 18 is formed. Therefore, according to a further teaching of the present invention, the finger loop member 18 is preferably formed from an extruded sheet comprised of a mixture of high density and low density polyethylene, the ratio by volume being 3:1 of high density to low density polyethylene. Both polyethylene materials are high polymers of ethylene, having a molecular weight of approximately 6000 or more. Typically, high and low density polyethylene is formed by the polymerization of ethylene either with peroxide catalysts or by metal alkyl catalysts in a hydrocarbon solvent. Formation of the finger loop member 18 from a material such as low density polyethylene results in the body 20 being of a softness such that the key ring 12 will readily pull through the body 20. Further, low density polyethylene would be too flexible to form a body 20 having a desired stiffness and strength. On the other hand, high density polyethylene would form a finger loop member 18 which would be too stiff and which would tend to crack when folded and creased. Since it is desirable for the spaced ends 24 and 26 of the finger loop member 18 to be readily compressible toward each other so as to allow the finger loop member 18 to take up a minimum amount of space on the key ring 12 during occasions when a particular key 14 is to be selected or to be used, the use of high density polyethylene or similar materials renders the finger loop member 18 difficult to compress, thereby negating certain advantages of the present structure. Accordingly, the finger loop member 18 can be preferably formed with a desired degree of flexibility and tensile strength through use of the mixture of high and low density polyethylene as described hereinabove. The advantages of the present structure are further maximized by forming the body 20 with a thickness of between 0.035 and 0.040 inch.

A melt from which the mixture of high density and low density polyethylene can be extruded into sheet form of the desired thickness is typically formed of high density linear polyethylene powder of a mesh particle size which facilitates melting thereof and a melt index typically between 6 to 18. Such a material is commercially available from the U.S. Industrial Chemicals Company under the designation ML-713 and MA-778 and from the Phillips Petroleum Company under the designation BMN TR-980. Low density linear polyethylene in powder form is also preferably used to form a melt for use in the formation of the finger loop member 18, the low density polyethylene powder typically being of a mesh particle size similar to that of the high density polyethylene and having a melt index of between 16 and 25. Such a material is commercially available from the U.S. Industrial Chemicals Company under the designation MC-91007 and 711-942 and from Union Carbide Corporation under the designation DNPA 0408. Blending of the dry materials from which the melt is formed can be accomplished manually or through the use of a rotating drum-type blender or other dry powder blender. Such blenders are well known in the art and include the rotating drum blenders commercially available from the Patterson-Kelly Company. The blended high density and low density polyethylene materials are formed into a melt and extruded in a well known manner to form sheet stock from which the body 20 can be preferably fashioned. The temperature of the melt is typically maintained at a temperature sufficient to bring both the low density and high density polyethylene into a fluent form, a typical temperature range being from 400° to 500° F.

Figure 8:
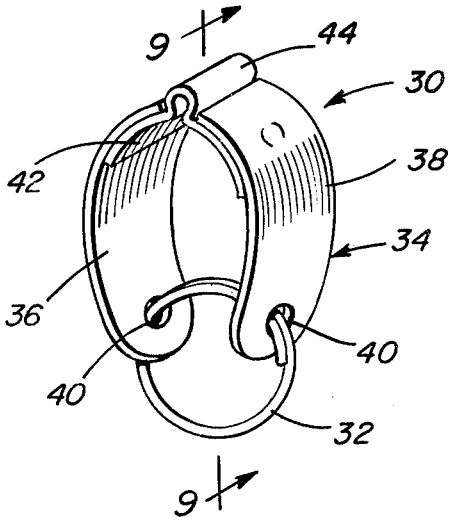
FIG. 8 is a perspective view of a second embodiment of the present key ring and finger loop assembly.
Figure 9:
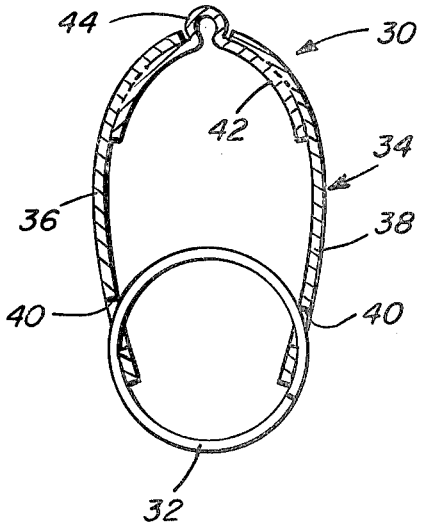
FIG. 9 is a sectional view taken generally along lines 9—9 of FIG. 8.

As can be seen in FIGS. 8 and 9, a key ring and finger loop assembly 30 can be formed according to a second embodiment of the invention to comprise a key ring 32 having a finger loop member 34 received and carried thereon. The finger loop member 34 is comprised of arcuate body portions 36 and 38 which can be preformed from a rigid material such as metal, relatively inflexible plastic, and the like. The arcuate body portions 36 and 38 are hinged together medially of the member 34 by means of a leaf spring hinge 42, the hinge 42 being flexible to allow non-deforming compression of the finger-loop member 34. The spring hinge 42 further acts to hold the finger-loop member 34 under tension on the key ring 32 by exerting a force on the arcuate body portions 36 and 38 which tend to separate the rounded spaced ends of said member 34. The arcuate body portions 36 and 38 are each seen to have an aperture 40 formed in the free ends thereof, the key ring 32 being received within the apertures 40 in the same manner as the key ring 12 is received within the apertures 22 of the finger loop member 18 as described hereinabove. The spring hinge 42 is further seen to be provided with a central rib 44 which provides conformational integrity to the hinge 42.

As can readily be understood, surfaces of the finger loop members 18 and 34 can be provided with decorative effects or advertising material. In the illustrated embodiments of the invention, the relatively light weight of the finger loop members 18 and 34 coupled with the desired degree of flexible resiliency causes the finger loop members 18 and 34 to standup even in a pocket, purse, or other environment.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a key ring assembly including a key ring adapted to receive and mount a plurality of keys or similar articles thereon, an article carried on the key ring for facilitating use in the assembly, comprising a body member having apertures formed in spaced ends thereof, the key ring being receivable through the apertures to mount the body member on the key ring in a loop-like conformation adapted to receive the finger of a user of the assembly therethrough, the body member being sufficiently resilient to exert a force tending to separate the spaced ends thereof, wherein the body member is formed from a flat strip-like sheet of resilient material.

2. In the assembly of claim 1 wherein the resilient material comprises a mixture of high and low density polyethylene.

3. In the assembly of claim 2 wherein the mixture comprises a ratio of high density to low density polyethylene of 3:1.

4. In the assembly of claim 2 wherein the thickness of the sheet forming the body member encompasses the range of 0.035 to 0.040 inch.

5. In a key ring assembly including a key ring adapted to receive and mount a plurality of keys or similar articles thereon, an article carried on the key ring for facilitating use in the assembly, comprising a body member having apertures formed in spaced ends thereof, the key ring being receivable through the apertures to mount the body member on the key ring in a loop-like conformation adapted to receive the finger of a user of the assembly therethrough, the body member being sufficiently resilient to exert a force tending to separate the spaced ends thereof, wherein the body member comprises:

a pair of substantially rigid body portions; and resilient hinge means for connecting the body portions at adjacent ends thereof, the hinge means exerting a force on the body portions tending to separate the spaced free ends thereof.

6. In the assembly of claim 5 wherein the body portions each have an aperture in the free end thereof, thereby to receive the key ring thereinto to mount the body member on the key ring.

7. In the assembly of claim 5 wherein the hinge means comprise a leaf spring, the ends of which are connected one each to one each of the body portions.

8. In the assembly of claim 7 wherein the leaf spring comprises a central rib between the adjacent ends of the body portions for reinforcing the spring.

9. In the assembly of claim 4 wherein the body portions are arcuate in conformation.

* * * * *